US008290613B2

(12) United States Patent
Shani

(10) Patent No.: US 8,290,613 B2
(45) Date of Patent: Oct. 16, 2012

(54) SYSTEM AND METHOD FOR CONTROLLING AND MANAGING AN AUTOMATED VEHICLE PARKING GARAGE

(75) Inventor: Haim Shani, Shoham (IL)

(73) Assignee: Unitronics (1989) (R"G) Ltd., Airport, Ben Gurion Airport (IL)

( * ) Notice: Subject to any disclaimer, the term of this patent is extended or adjusted under 35 U.S.C. 154(b) by 734 days.

(21) Appl. No.: 12/119,088

(22) Filed: May 12, 2008

(65) Prior Publication Data

US 2008/0288104 A1 Nov. 20, 2008

Related U.S. Application Data

(60) Provisional application No. 60/938,857, filed on May 18, 2007, provisional application No. 60/938,870, filed on May 18, 2007.

(51) Int. Cl.
*G06F 7/00* (2006.01)
*B65G 65/00* (2006.01)
*E04H 6/00* (2006.01)

(52) U.S. Cl. ..... 700/217; 700/214; 700/213; 700/218; 414/273; 414/231; 414/232; 414/234; 414/227

(58) Field of Classification Search ..... None
See application file for complete search history.

(56) References Cited

U.S. PATENT DOCUMENTS

| | | | | |
|---|---|---|---|---|
| 5,091,727 | A | 2/1992 | Mahmood | |
| 5,108,254 | A | 4/1992 | Go | |
| 5,330,305 | A | 7/1994 | Go | |
| 5,669,753 | A | 9/1997 | Schween | |
| 6,502,011 | B2 * | 12/2002 | Haag | 700/217 |
| 6,662,077 | B2 * | 12/2003 | Haag | 700/217 |
| 7,135,991 | B2 | 11/2006 | Slemmer | |
| 2005/0047895 | A1 * | 3/2005 | Lert, Jr. | 414/273 |
| 2006/0212344 | A1 | 9/2006 | Marcus | |
| 2007/0031218 | A1 * | 2/2007 | Haag | 414/227 |
| 2007/0050271 | A1 * | 3/2007 | Ufford et al. | 705/28 |

FOREIGN PATENT DOCUMENTS

WO WO 91/10794 7/1991

OTHER PUBLICATIONS

PCT International Search Report issued Jul. 7, 2009 by the European Patent Office ( 4 pages).

* cited by examiner

*Primary Examiner* — Gene Crawford
*Assistant Examiner* — Yolanda Jones
(74) *Attorney, Agent, or Firm* — Smith Gambrell & Russell LLP

(57) ABSTRACT

An automated parking system and method for controlling a parking garage employ a distributed control system to control the transport of a vehicle between an entry/exit station and a parking space. The distributed control system employs an independent controller (PLC) for each mechanical element, such as elevators and shuttle cars. The PLCs are interconnected by a network and coordinate with each other to control the operation of the automated parking system. An operator panel including a touchscreen display may be used by an operator to control directly the operation of a particular PLC and its associated mechanical element. A central management computer is used to coordinate the overall operation and management of the distributed control system and to provide enhanced features including redundant safety checks.

29 Claims, 10 Drawing Sheets

SYSTEM AND METHOD FOR CONTROLLING AND MANAGING AN AUTOMATED VEHICLE PARKING GARAGE

CLAIM OF PRIORITY

This application claims priority from U.S. Provisional Patent Application Ser. No. 60/938,857 filed May 18, 2007 and U.S. Provisional Patent Application Ser. No. 60/938,870 filed May 18, 2007, both of which are incorporated herein in their entirety.

FIELD OF THE INVENTION

This invention relates to an automated system and an automated method for storing items in a three-dimensional warehousing facility, particularly an automated parking system and an automated parking method for a three-dimensional vehicle parking garage that efficiently and automatically stores and retrieves vehicles, including passenger cars or other vehicles.

BACKGROUND OF THE INVENTION

In a conventional three-dimensional automated vehicle parking garage, mechanical elements or motorized conveyances, such as lifts (elevators), cranes, shuttle cars (moving platforms), turntables, and other mechanical elements are used to transport a vehicle from an entry/exit station at the arrival/departure level of the parking garage to a parking space in the parking garage and then retrieve the vehicle from the parking space and transport the vehicle to the entry/exit station, without human assistance.

In general, a typical automated vehicle parking garage consists of a storage (or parking) area with individual parking spaces, one or more entry/exit stations (or bays) for accepting a vehicle from a customer for parking and for delivering the vehicle to the customer upon retrieval, and motorized conveyances (mechanical elements), such as elevators and shuttle cars, used to transport the vehicle from the entry/exit station to the parking space and to transport the vehicle from the parking space to the entry/exit station for customer retrieval. The conventional three-dimensional automated vehicle parking garage is controlled and managed by a central control system based on PLCs (programmable logic controllers) or other control circuitry, and by central management software running on a central management computer that operates the central control system.

In a conventional automated vehicle parking garage, the central control system is typically resident on a PLC (programmable logic controller) or other control circuitry and the central management software is typically resident on a central management computer that receives inputs from and sends command to the various mechanical elements (e.g. elevators and shuttle cars) thus coordinating the movement of those mechanical elements in order to transport a vehicle between the entry/exit station and the parking space. If the central management computer experiences a failure, the whole management and operation of the automated vehicle parking garage is disabled thereby leaving vehicles stranded in parking spaces.

SUMMARY OF THE INVENTION

In order to overcome the deficiencies of the prior automated vehicle parking garages, an automated parking system and automated parking method is disclosed that uses a distributed control system to control the transport of a vehicle from the entry/exit station to the parking space and to control the transport of the vehicle from the parking space to the entry/exit station. The distributed control system handles all functional, operational, and safety issues of the three-dimensional automated vehicle parking garage without the need for a central management computer running central management software. While not necessary to the operation of the critical functions of the automated vehicle parking garage, a central management computer can be used with the automated parking system and automated parking method of the present invention to provide enhancements and coordination to the automated parking system.

Distributed Control System

In the disclosed automated vehicle parking garage, the mechanical elements or motorized conveyances (e.g. elevator, shuttle car, etc.) of the automated vehicle parking garage are driven by electrical motors (or other means such as hydraulic or pneumatic drive systems). Each mechanical element of the automated vehicle parking garage has an associated independent controller, either a programmable logic controller (PLC) or an embedded controller, each contained in a separate electrical cabinet associated with the mechanical element. Each independent controller, with its controller program, controls the movement of the associated mechanical element and communicates, via a network, with other controllers associated with other mechanical elements of the automated vehicle parking garage. Therefore, the movement and interaction of the mechanical elements is coordinated by the distributed independent controllers in communication with each other over the network, with or without central management software running on a central management computer. Each independent controller includes a database or a data table in its memory for saving operating and safety parameters such as motion parameters (e.g. limitations, speed, motion profiles, etc.), history, events, and more.

Because the disclosed control system is distributed, failure of one independent controller or its associated mechanical element or failure of the central management computer will not disrupt the entire operation of the automated parking system of the parking garage. Because the controllers are in communications with each other over the network, the controller program in one of the controllers can take over the operations of another one of the controllers in the event that the other controller malfunctions. The distributed control system, where every mechanical element or motorized conveyance has its own independent controller, increases reliability and decreases mean time to repair (MTTR) for the automated vehicle parking garage.

The independent controllers are interconnected by means of a single standard network. A single standard network allows easy access to all of the independent controllers, allows distribution and redistribution of the controller programs among the controllers on the network, and allows control of the whole control system from any computer or independent controller on the network. The distributed control system also provides the benefit of fast, independent access to each controller for maintenance and service. Such architecture also allows each independent controller to communicate directly with other independent controllers without the intervention of a central management computer, especially when safety and emergency operations are required. The independent controllers that make up the distributed control system may be interconnected through a wired or a wireless (infra-red or radio frequency) local area network. Such a local area network enables fast and efficient communication between the independent controllers (PLCs) and the central management computer.

As an optional feature, the local area network may also include cellular network support to the independent controllers. The cellular network support allows an automatic short text message to be sent directly from a malfunctioning subsystem, such as an independent controller and/or its associated mechanical element, to a local maintenance person or to a support desk when required. The cellular network support is implemented by attaching one or more cellular gateways or modems to one or more of the independent controllers. The use of the cellular network support improves support response time and increases availability of the automated parking system by reducing MTTR.

In another embodiment, the independent controller is an embedded controller, which like a PLC, is an independent controller specifically designed to control a mechanical element, but without the "general purpose" programming capability of a PLC. In both implementations of the independent controller (PLC or embedded controller), each independent controller consists of a central processing unit (CPU), memory, input/output (I/O) capabilities, communication capabilities, and all related circuitry. A controller program is loaded in each of the independent controllers to enable control of the associated mechanical element. The controller program in the independent controller performs all functional requirements for each associated mechanical element, as well handling safety and emergency issues associated with the operation of the associated mechanical element.

In another embodiment, the control of the distributed control system may be performed by one or more personal computers remotely controlling the mechanical elements using remote input/output devices interconnected via a wired or wireless bus or network. In such an embodiment, the majority of the control functions are performed by the remote personal computers, and only a few control functions, related mainly to safety and emergency issues, are performed locally by each of the independent controllers or remote input/output devices attached to its associated mechanical element.

In one embodiment, all independent controllers (PLCs, embedded controllers, or personal control computers) are equipped with a graphical operator panel including a touchpad and display. For each mechanical element, the graphical operator panel can be permanently attached to the mechanical element, the graphical operator panel can be mounted on the mechanical element only when required, or the graphical operator panel can be used remotely (such as a hand-held panel) using wireless communication with the independent controller for the associated mechanical element.

For each independent controller, the associated graphical operator panel gives the operator access to messages generated by the independent controller and access to displays relating to the status of the associated mechanical element. Messages can be normal operating messages or error notification messages for troubleshooting. Relevant data can be accessed directly through the graphical operator panel without the need for an external computer. The graphical operator panel for the independent controller also allows the operator to issue commands directly to the associated mechanical element. This means that a mechanical element, such as elevator or shuttle car, can be switched to manual operation and can be "driven" manually with its own graphical operator panel to allow the release of vehicles, should a problem occur in the independent controller, the personal computers, or the central management computer.

Central Management Computer and Software

All the independent controllers are connected via the network to the central management computer, when a central management computer is provided as part of the control system. The central management software running on the central management computer is a software package designed to manage, operate, control, and monitor operation of the mechanical elements and their deployment in the three-dimensional automated vehicle parking garage. The central management software is designed to run on a PC hardware platform equipped with communication ports that allow constant communication over the network with all independent controllers that make up the distributed control system.

The central management computer with its central management software sends high level commands, such as "load car", "move car" and "unload car" to the elevator and shuttle cars, and keeps constant track of the current location of each vehicle in the parking garage, whether in transit or stationary. A high level command, such as "load car," is then translated to a series of sequential operations or movements by either the independent controller, or by a software component of the central management software referred to as material flow control (MFC) module.

The central management software maintains a database or other equivalent data structure, required to provide overall management of the distributed control system. The information managed by the central management software in such data structures includes without limitation: a virtual map of the parking area and information about all parking spaces, all parked vehicles, operators, and parking history, among other relevant items of management information. The central management software is designed to operate in manual, automatic, and combined modes, providing flexible and comprehensive support in processing all vehicle movements in the three-dimensional automated vehicle parking garage, as well as managing and optimizing the entire automated parking method in the parking garage.

As previously noted, in one embodiment, the central management software includes a software module referred to as material flow control (MFC) software module. The MFC software module provides an interface between the central management software and the control system's independent controllers. The MFC software module relays real-time information about the status of each of the moving mechanical elements to the independent controllers, the personal control computers, and the central management computer. For example, the MFC software module tracks the status of the mechanical elements by relaying status information which includes, position, operation mode, status, current action being performed, errors, and more.

Operational instructions are sent from the central management software through the MFC software module to the independent controllers for the mechanical elements. All instructions currently in process may be shown to the operator via the graphical operator display of the central management computer, and the instructions can be manipulated by the central management software. The MFC software module is the software component that is responsible for sending all instructions to all independent controllers of the automated parking system, and the MFC software module is, in the first instance, responsible for the safe operation of the control system.

With every instruction sent by the MFC software module to the independent controllers, safety checks are performed, in order to make sure that the operation initiated by the instruction is allowed in view of the current status of the automated parking system. This safety check performed by the central management software is redundant with safety checks performed by the independent controllers, thus assuring safer operation of the automated parking system. Consequently, the central management software and the controller program in the distributed independent controllers serve as redundant systems for safety checks, and if one fails to identify a safety issue, the other one will likely identify the safety issue instead.

The central management software graphically presents a map of the complete parking garage using the central computer video screen display and input devices (keyboard, mouse, etc.), which is a synoptic advanced graphical user interface (GUI). In one embodiment this real time synoptic map of the parking garage provides the parking garage operators with additional monitoring, visual indications, and tools to view and control the automated parking system. The GUI includes, for example, a real time vehicle transportation display, a storage layers display, a parking occupancy display, a throughput and statistical parameters display, a real time control screen, a troubleshooting operations display, and more. The synoptic map may further provide: a real time movements display of vehicles, zooming in and out of a map area, a moving view within map boundaries, color coded views, and an interactive control by clicking elements on the map.

In one embodiment, the central management software automatically manages the parking spaces by implementing a "best location method", which determines the best parking space for each vehicle being parked, based on all the information defined in the automated parking system such as vehicle's dimensions, owner, priority, usage history, the automated parking system's current load and capacity, safety considerations, and more.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
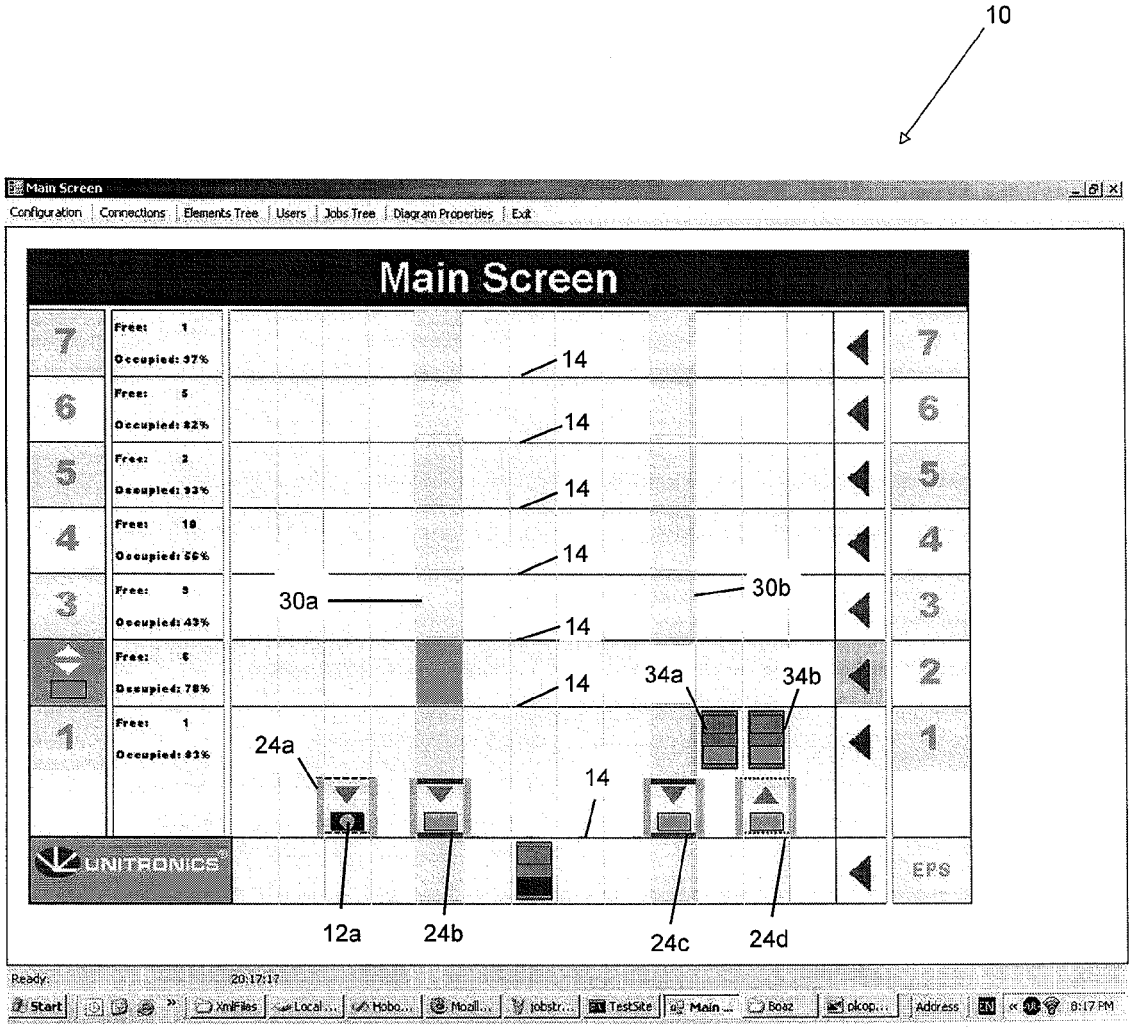
FIG. 1 is a screenshot depicting a schematic elevation view of a three-dimensional automated vehicle parking garage in accordance with the present invention, as part of the real time synoptic map of the parking garage.
Figure 2:
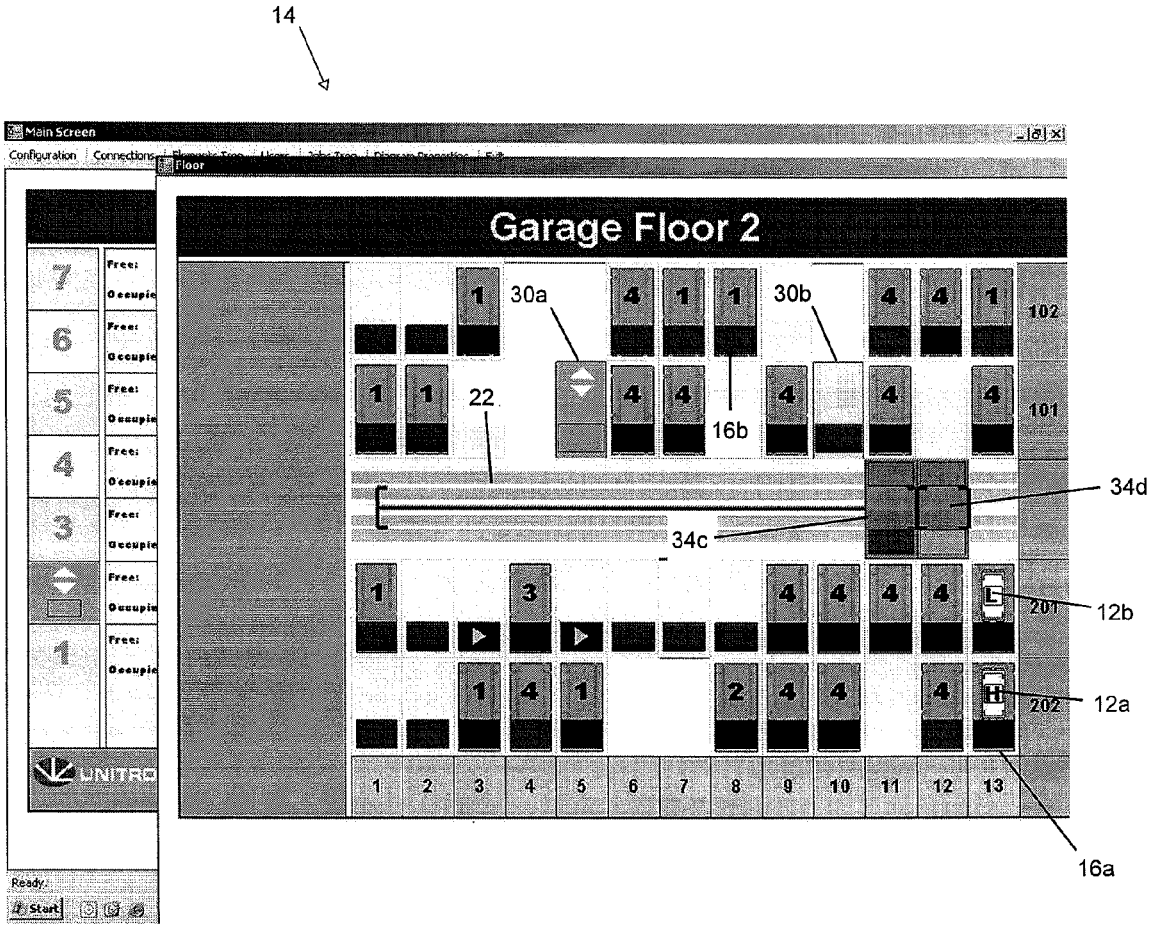
FIG. 2 is a screenshot depicting a schematic plan view of a floor (parking area) of the three-dimensional automated vehicle parking garage in accordance with the present invention, as part of the real time synoptic map of the parking garage.

Turning to FIG. 1, a three-dimensional automated vehicle parking garage 10 is illustrated schematically by means of a screenshot generated by central management software in a central management computer, which will be described in greater detail below. The parking garage 10 has parking areas 14 (floors 1-7) for vehicles 12, such as vehicle 12*a*. The parking garage 10 has parking or storage spaces 16 on each of the floors 1-7 (FIG. 2). With continuing reference to FIG. 1, the parking garage 10 has four entry/exit stations or delivery bays 24*a*, 24*b*, 24*c*, and 24*d* for accepting a vehicle, for example the vehicle 12*a* in entry/exit station 24*a*, from a customer for parking and for delivering the vehicle 12*a* to the customer at one of the entry/exit stations 24*a*, 24*b*, 24*c*, and 24*d* of the parking garage 10.

The vehicle 12*a* is moved from the entry/exit station 24*a* by means of mechanical elements or motorized conveyances, such as shuttle cars 34 and elevators 30. For example, floor 1 of parking garage 10 has two shuttle cars 34*a* and 34*b* and two elevators 30*a* and 30*b*. For the vehicle 12*a* presented for parking at the entry/exit station 24*a*, the shuttle car 34*a* moves the vehicle 12*a* from the entry/exit station 24*a* to a parking space 16 on floor 1. If no parking space 16 is available on floor 1, the shuttle car 34*a* carries the vehicle 12*a* to elevator 30*a*. The elevator 30*a* lifts the vehicle 12*a* from floor 1 to the next upper floor, of floors 2-7, with an available parking space 16. When the vehicle 12*a* reaches the next upper for with an available parking space 16, a shuttle car 34 on that upper floor retrieves the vehicle 12*a* from the elevator 30*a* and delivers the vehicle 12*a* to the available parking space 16.

The layout of floor 2, which is typical of floors 2-7, is shown schematically in FIG. 2. Each parking space 16 on floor 2 is identified by a floor number, a row number, and a rank number. For example, the parking space 16*a* in FIG. 2 is identified by floor 2, row 13, and rank 202, the parking space 16*b* in FIG. 2 is identified by floor 2, row 8, and rank 102, and so on. An aisle 22 on floor 2 extends along the length of the parking garage 10 between rank 101 and rank 201. The elevators 30*a* and 30*b* are located along the aisle 22. The shuttle cars 34*c* and 34*d* on floor 2 move along aisle 22 between the elevators 30*a* and 30*b* in order to deliver vehicles from the elevators to the parking spaces, such as the vehicle 12*a* from elevator 30*a* to the parking space 16*a* (floor 2, row 13, rank 202), or to retrieve the vehicle 12*a* from the parking space 16*a* (floor 2, row 13, rank 202) and to return the vehicle 12*a* to the elevator 30*a*. The selection of the particular shuttle car 34*c* or 34*d* and the particular elevator 30*a* or 30*b* is made by the distributed control system and depends on the location and status of those particular mechanical elements at the time the instruction is issued to move the vehicle 12*a* between the parking space 16*a* and one of the elevators 30*a* or 30*b* on floor 2.

The Distributed Control System

Figure 3:
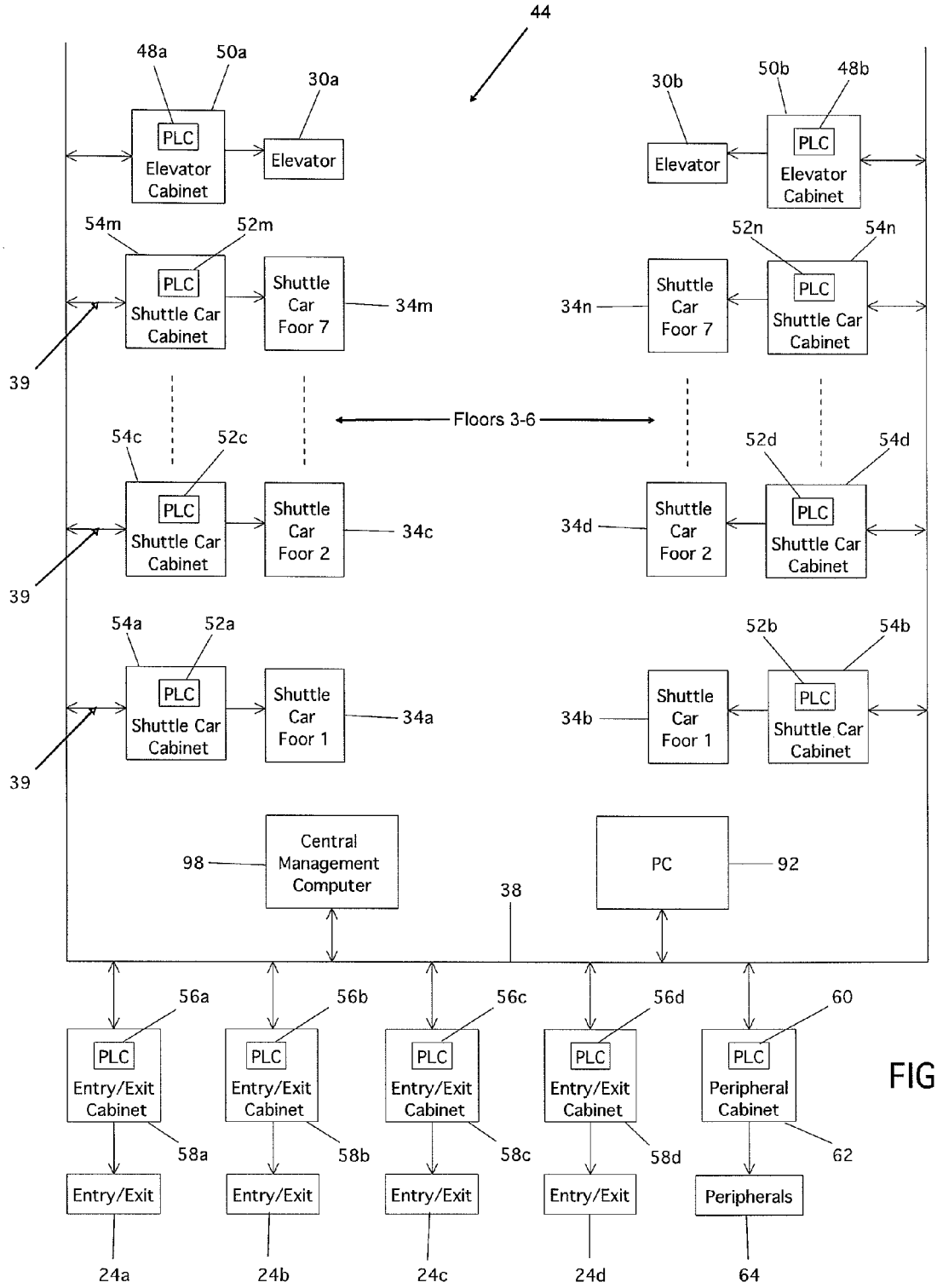
FIG. 3 is a block diagram of a distributed control system for the three-dimensional automated vehicle parking garage in accordance with the present invention.

FIG. 3 illustrates a distributed control system 44 for controlling the transport of the vehicle 12*a* from the entry/exit station 24*a* on floor 1 (FIG. 1) to the parking space 16*a* (floor 2, row 13, rank 202) (FIG. 2) and for controlling the transport of the vehicle 12*a* from the parking space 16*a* (floor 2, row 13, rank 202) (FIG. 2) back to the entry/exit station 24*a* on floor 1 (FIG. 1) for delivery to a customer.

The distributed control system 44 controls the operation of the mechanical elements of the seven floor, three-dimensional automated parking garage (FIG. 1) including for example, the elevators 30*a* and 30*b*, shuttle cars 34*a*-34*n*, entry/exit stations 24*a*-24*d*, and system peripheral devices 64. An electrical control cabinet and an independent controller (either a PLC, as illustrated, or an embedded controller) is associated with each of the mechanical elements for controlling the operation of the associated mechanical element. The distributed control system 44 includes elevator independent controllers (PLCs) 48*a* and 48*b* within elevator control electrical cabinets 50*a* and 50*b* for controlling elevators 30*a* and 30*b* respectively, shuttle car independent controllers (PLCs) 52*a*-52*n* within shuttle car control electrical cabinets 54*a*-54*n* for controlling shuttle cars 34*a*-34*n* respectively, entry/exit station independent controllers (PLCs) 56*a*-56*d* within entry/exit station control electrical cabinets 58*a*-58*d* for controlling entry/exit stations 24*a*-24*d* respectively, and peripheral independent controller (PLC) 60 within main system electrical cabinet 62 for controlling system peripheral devices 64. The system peripheral devices may include, for example, magnetic card or RF-tag readers, annunciating panels, driver guiding traffic lights, etc. In addition, the distributed control system 44 may include a central management computer 98 and one or more personal computers 92.

The independent controllers 48 (elevator), 52 (shuttle car), 56 (entry/exit station), and 60 (peripherals), a personal computer 92, and a central management computer 98 are all connected together by means of a network 38. With respect to the shuttle cars 34, the independent controllers 52 for the shuttle cars 34 are connected to the network 38 via wired or wireless connections 39. While the independent controllers 48 (elevator), 52 (shuttle car), 56 (entry/exit station), and 60 (peripherals) can together operate the distributed control system 44 without the personal computer 92 or the central management computer 98, the personal computer 92 and the central management computer 98 provide additional capabilities for the automated parking system. The personal computer 92 may remotely control one or more of the mechanical elements (elevators, shuttle cars, entry/exit stations) using remote input/output devices interconnected via the network 38. In such an embodiment, the majority of the control functions are performed by the remote personal computer 92, and only a few control functions, related mainly to safety and emergency issues, are performed locally by each of the independent controllers 48 (elevator), 52 (shuttle car), 56 (entry/exit station), and 60 (peripherals).

Figure 4:
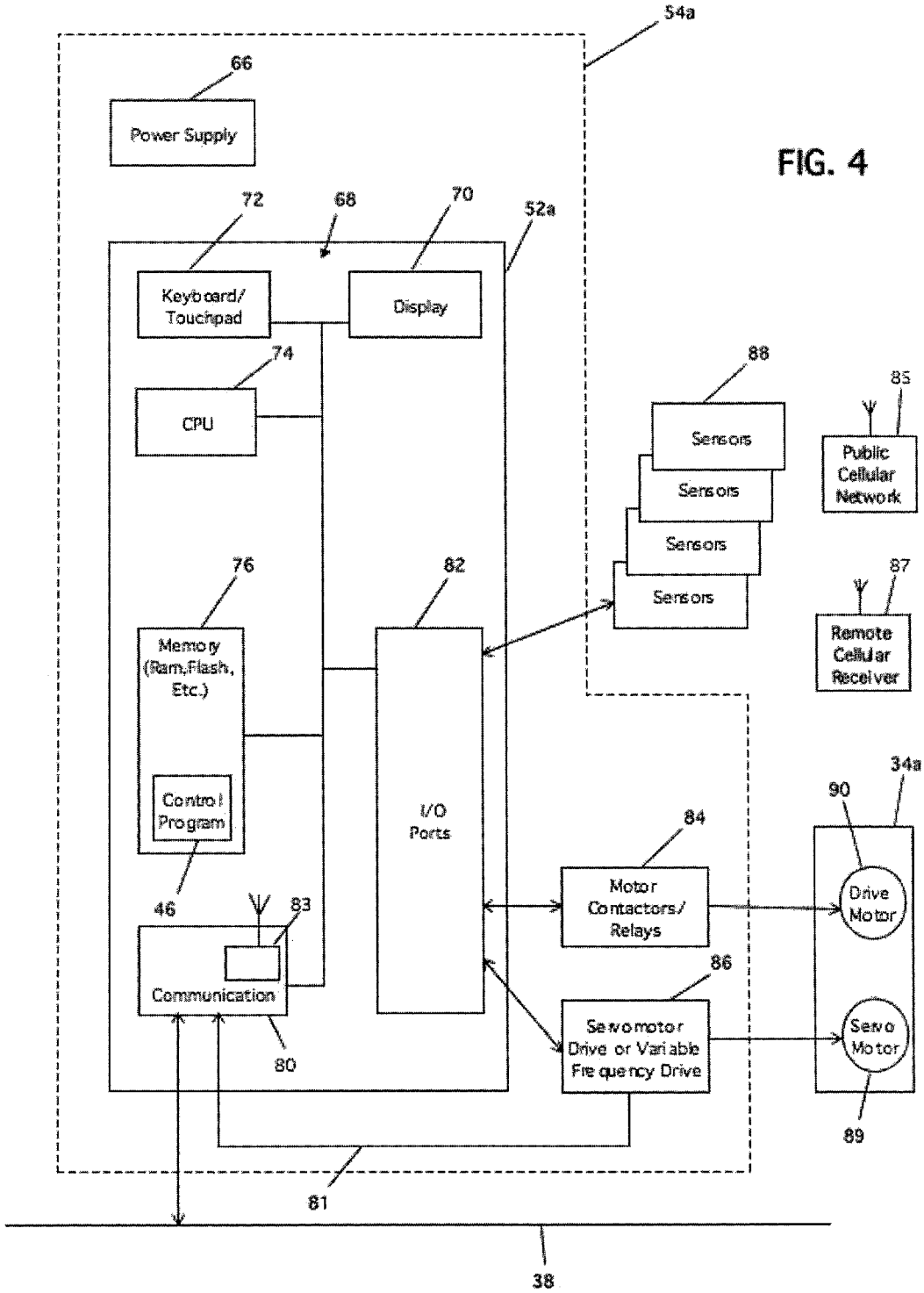
FIG. 4 is a block diagram of a controller electrical cabinet with a programmable logic controller that is part of the distributed control system for the three-dimensional automated vehicle parking garage in accordance with the present invention.

FIG. 4 illustrates an electrical cabinet, for example, the shuttle car electrical cabinet 54*a* used to control the operation of shuttle car 34*a*. The shuttle car 34*a* may include, for example a shuttle car servomotor 89 and a shuttle car drive motor 90. In the case of other mechanical elements, such as elevators 30 where heavy loading is encountered, and AC induction motor is used instead of a servomotor. In other mechanical elements a stepper motor may be employed in place of a servomotor. Further, external sensors 88 may be attached to the shuttle car 34*a* or may be located along the aisle 22 to monitor the operating parameters (speed, acceleration, load weight, etc.) and position of the shuttle car 34*a*. The shuttle car electrical cabinet 54*a* includes a power supply 66, the independent controller (PLC) 52*a*, a motor contactor/relay 84, and a servomotor drive (or variable frequency drive) 86. The PLC 52*a* includes a graphical operator panel 68, comprising a display 70 and a touch pad (or keyboard) 72, a central processor unit (CPU) 74, a memory 76, a communication module 80, and input/output ports 82. A resident controller program 46 for controlling the operation of the independent controller 52*a* resides in memory 76. The independent controller 52*a* receives inputs on input/output ports 82 from sensors 88 that monitored the operating parameters and the position of the shuttle car 34*a*.

Based on the input signals from sensors 88 and the processing of those input signals by the controller program 46, the independent controller 52*a* controls the operation of the shuttle car 34*a* by controlling the operation of the motor contactor/relay 84 and the servomotor drive 86 connected to the drive motor 90 and the servomotor 89 respectively. With respect to the drive motor 90 and the servomotor 89, the controller program 46 of the independent controller 52*a* includes target positions and motion profiles that create trajectories for the drive motor 90 and the servomotor 89 to follow. By using the target positions and the motion profiles, the independent controller 52*a*, by means of the output signals to the motor contactors/relays 84 and to the servomotor drive 86, can precisely maneuver the shuttle car 34*a* to a predetermined position using a predetermined set of acceleration, speed, and deceleration parameters.

In connection with the operation of other mechanical elements such as elevator 30 where heavy loading is encountered, AC induction motors are employed instead of servomotors. The controller program in the independent controller, such as the elevator independent controller 48 for the elevator's AC induction motor likewise has target positions and the motion profiles for precisely maneuvering the elevator car from floor to floor using a predetermined set of acceleration, speed, deceleration, and positioning parameters with respect to the floors of the parking garage 10. The output signal from the independent controller 48 for the elevator 30, for example, controls the AC induction motor by using a variable frequency drive (VFD) signal that controls the speed of the induction motor. The VFD signal controls the speed of the induction motor by varying the frequency of the voltage applied to the motor. In order to complete the control loop positioning information from external sensors (such as absolute and incremental encoders) is independently acquired and compared to the target positions and motion profiles to refine the trajectories for the motor to follow. The controller programs of the independent controllers also implement fine positioning of the mechanical elements, such as the alignment between a shuttle car and a parking space, with automatic database updates when corrections are made. If, for example, a structural change occurs in the parking area (e.g. slab sinking, light earthquakes, structure deformation, etc.), the independent controller of a shuttle car detects such change, and the new physical coordinates of the parking space are stored by the independent controller for faster retrieval for the next time the same parking space is encountered. In addition, the individual controllers can check mechanical element positioning based on absolute encoders, allowing constant position tracking and eliminating the need for recalibration or repositioning following power failures. Further, the individual controllers can smooth the starting and stopping of mechanical elements when a non-emergency stop request for a mechanical element issues. Under such circumstances, the mechanical element (e.g. a shuttle car) first finishes its current operation and then stops, allowing a smooth start when the stop request is removed.

In addition to communicating with the network 38, the communication module 80 of independent controller 52 communicates directly with the servomotor drive 86 via feedback loop 81 in order to monitor the status of the servomotor drive 86. The communication module 80 may also include cellular network support. Having cellular network support in the communication module 80 allows an automatic short text message to be sent directly from the malfunctioning shuttle car 34*a* to a local maintenance person or to a support desk when required. The cellular network support for communication module 80 is implemented by attaching a cellular gateway or modem 83 to the independent controller 52*a*. The cellular modem or router 83 communicates status information about the controller 52*a* over a cellular network 85 to a remote receiver 87 of a maintenance person or support desk. Cellular network capability can be added to one or more of the independent controllers 48 (elevator), 52 (shuttle car), 56 (entry/exit station), and 60 (peripherals) to provide maintenance and reliability for the distributed control system 44.

The graphical operator panel 68 can be permanently attached to the shuttle car 34*a*, the graphical operator panel 68 can be mounted on the shuttle car 34*a* only when required, or the graphical operator panel 68 can be used as a hand-held remote control using wireless communication with the independent controller 52*a* for the associated shuttle car 34*a*. The graphical operator panel 68 for the independent controller 52*a* also allows the operator to issue commands directly to the shuttle car 34*a*. Consequently, the shuttle car 34*a* can be manually operated with its own graphical operator panel 68 to allow the release and delivery of vehicles from the parking garage 10, should a problem occur in the personal computer 92 or the central management computer 98. The graphical user panel 68 is accessed by an operator with a user password authentication for each independent controller. Further, the electrical cabinet 54*a* is a fast plug-in unit that can be removed and replaced completely for quick repair in case of a failure of an electric cabinet 54 for any critical mechanical element of the automated parking system.

The distributed control system 44 implements a number of features implemented by the controller program in the individual controllers. For example, the individual controllers can, by means of appropriate sensors, constantly monitor the height and width of objects hanging out of vehicles, can recheck vehicle height (after initial check) for positioning a vehicle in a size-appropriate parking space, can check parking space vacancy (in double deep structures), and can block or unblock parking locations (in addition to blocking and unblocking by the central management computer).

The distributed control system 44, by means of the individual controllers, supports enhanced safety mechanisms (detection and handling) including automatic detection of a slack rope condition in elevators, automatic detection of motor rotation over speeding, detection of overweight vehicles, and automatic independent mechanical/electronic emergency stop mechanism at aisle ends.

The distributed control system 44, by means of the individual controllers, provides support for complete backup and for the ability to edit data off-site for fast restore. The distributed control system 44 further provides advanced independent controller log capabilities, including logging of elevator/shuttle car error and malfunction history, variable frequency drive and servo drive errors and malfunction history on a per motor basis, recent commands, accumulated usage of each motor, maintenance reminders, and log configuration changes (for tracking purpose).

The Central Management Computer and Software

Figure 5:
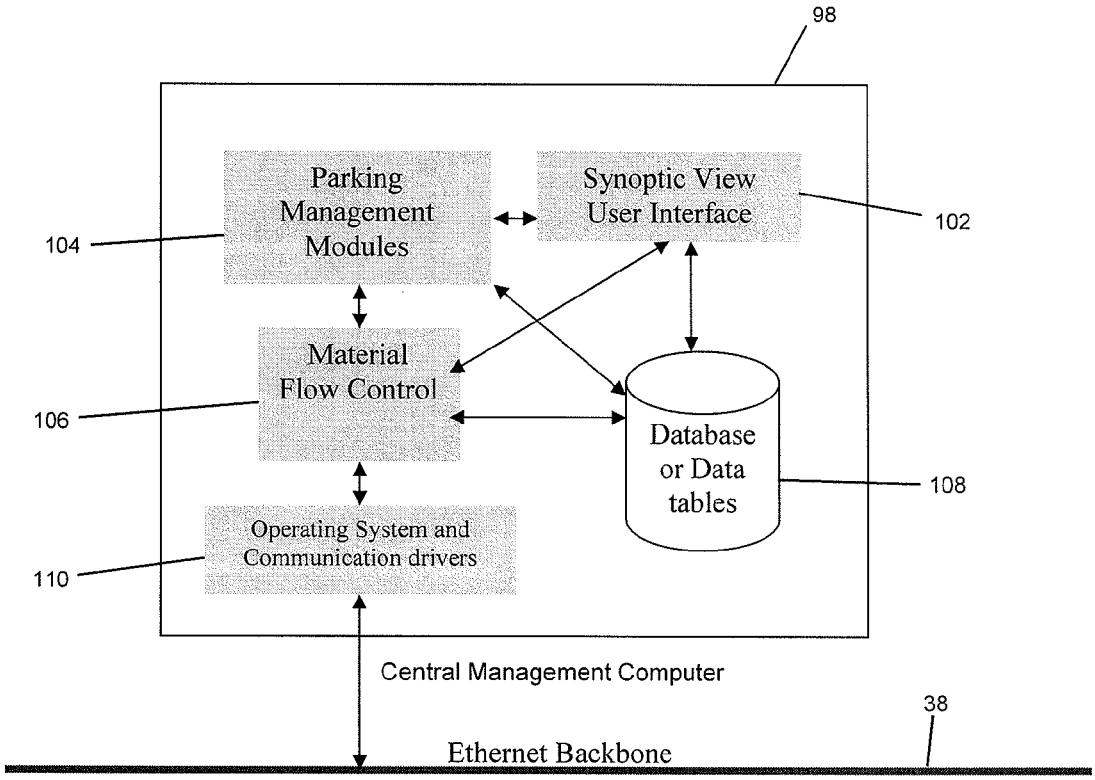
FIG. 5 is a block diagram of a central management computer that may be used in conjunction with the distributed control system for the three-dimensional automated vehicle parking garage in accordance with the present invention.

FIG. 5 illustrates the central management computer 98. The central management computer 98 comprises a central computer graphical video screen display and input devices 102, a parking management module 104, a material flow control (MFC) software module 106, a database 108, and operating system and communications drivers 110. The central management computer 98 runs the central management software which, while not critical to the operation of the parking garage 10, provides centralized services for the distributed control system 44.

The central management software running on the central management computer 98 manages, operates, controls, and monitors operation and deployment of the mechanical elements, including elevators 30, shuttle cars 34, and entry/exit stations 24. The central management computer communicates over the network 38 with all independent controllers 48 (elevator), 52 (shuttle car), 56 (entry/exit station), and 60 (peripherals) that make up the distributed control system 44.

The central management computer 98 shares the control of the distributed control system 44 with the independent controllers 48 (elevator), 52 (shuttle car), 56 (entry/exit station), and 60 (peripherals). Particularly, the central management software of the central management computer 98 keeps track of the current location of each vehicle in the parking garage, whether in transit or stationary and sends high-level commands, such as "load car", "move car," and "unload car" to the independent controllers 48, 52, 56, and 60 of the distributed control system 44. The high-level commands are then translated to a series of sequential operations or movements by either the independent controllers 48, 52, 56, and 60 or by the material flow control (MFC) software module 106.

Figure 6:
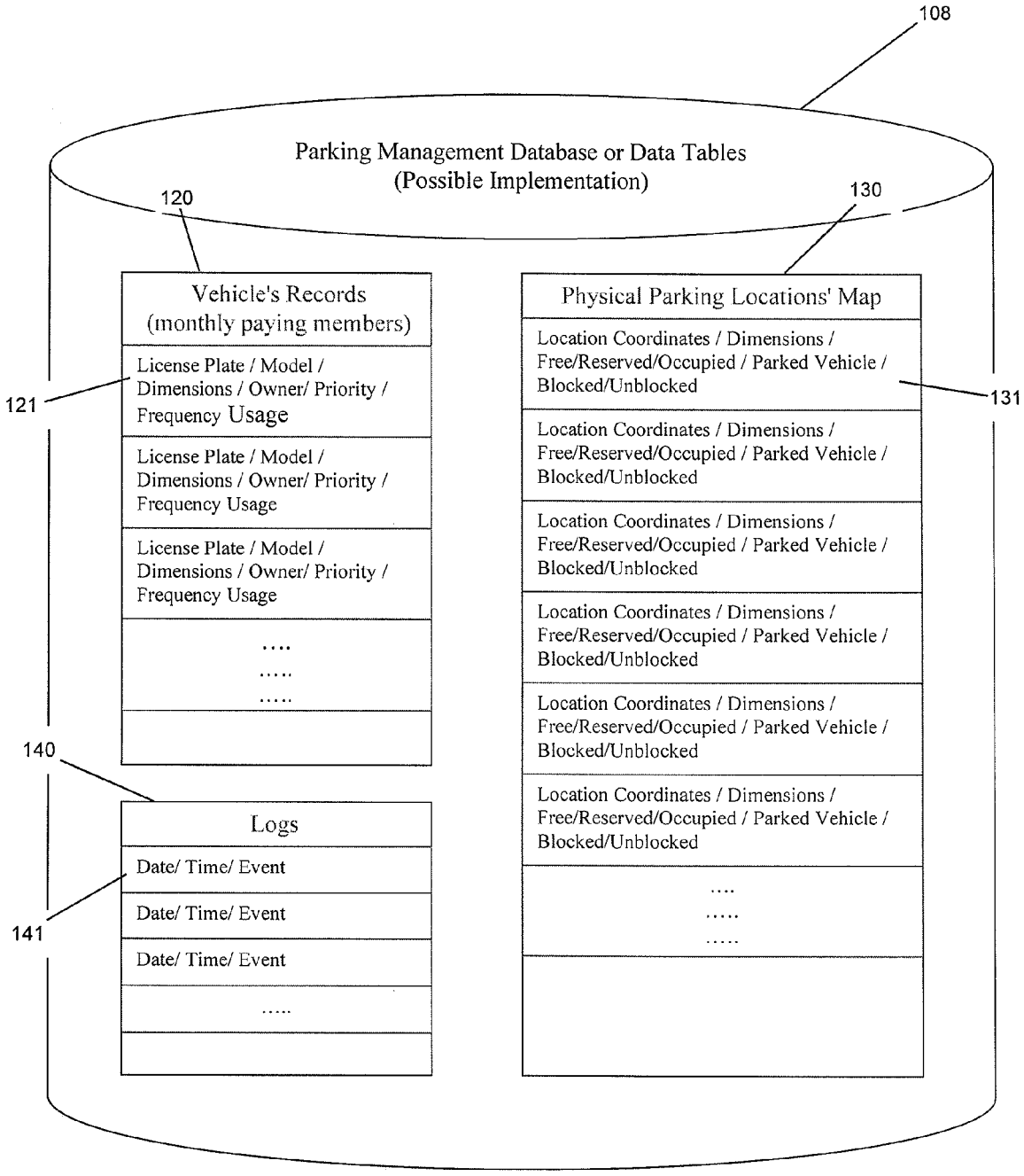
FIG. 6 is a schematic diagram of a database used in connection with the central management computer that may be used in conjunction with the distributed control system for the three-dimensional automated vehicle parking garage in accordance with the present invention.

The central management computer 98 maintains a database or other equivalent data structure 108, required to operate within the distributed control system 44. As shown in FIG. 6, one illustrative database includes information used by the central management software to assist in the management of the distributed control system 44 of the automated parking system. For example, the data structures included in database 108 and illustrated in FIG. 6 include a vehicle identification records table 120, a physical parking locations table 130, and a logs table 140. The vehicle records table 120 includes, by way of example, a record for each vehicle including license plate, model, dimensions, owner, priority, frequency of usage, etc. The physical parking locations table 130 includes, by way of example, a record 131 for each parking space 16 including location coordinates, dimensions, free/reserved/occupied flags, parked vehicle identification, block or unblock flags, etc. The logs table 140 includes, by way of example, a record 141 for each parking transaction or other event including date, time, and event identification. The information maintained in database 108 is illustrative of the sort of information used by the parking management modules 104 of the central management computer 98 to manage the distributed control system 44 and to administer the automated parking garage 10.

In connection with managing the distributed control system 44, the MFC software module 106 provides an interface between the central management software and the independent controllers 48, 52, 56, and 60 of the distributed control system 44. The MFC software module 106 relays real-time information about the status of each of the mechanical elements, elevators 30, shuttle cars 34, and entry/exit stations 24 to the independent controllers 48, 52, 56, and 60, the personal control computer 92, and the central management computer 98. The status provided by the MFC software module to the independent controllers 48, 52, 56, and 60, to the personal control computer 92, and to the central management computer 98 includes, for example, position, operation mode, status, current action being performed, errors, and more for the mechanical elements, elevators 30, shuttle cars 34, and entry/exit stations 24.

Operational instructions are sent from the central management software through the MFC software module 106 to the independent controllers 48, 52, 56, and 60 for the mechanical elements, elevators 30, shuttle cars 34, and entry/exit stations 24. All instructions currently in process are shown to the operator via the graphical display 102 of the central management computer 98, and the instructions can be manipulated by the central management software. The MFC software module 106 is the software component that is responsible for sending all instructions to all independent controllers 48, 52, 56, and 60 of the automated parking system, and the MFC software module 106 is, in the first instance, responsible for the safe operation of the automated parking system.

With every instruction sent by the MFC software module 106 to the independent controllers 48, 52, 56, and 60, safety checks are performed, in order to make sure that the operation initiated by the instruction from the MFC software module 106 is allowed in view of the current status of the automated parking system. This safety check performed by the central management software is redundant with safety checks performed by the independent controllers 48, 52, 56, and 60, thus assuring safer operation of the automated parking system.

The graphical display 102 of the central management computer 98 can present a map of the complete parking garage such as shown in FIG. 1. The central computer display 102 includes a synoptic advanced graphical user interface (GUI). In one embodiment this real time synoptic map of the parking garage provides the parking garage operator with additional monitoring, visual indications, and tools to view and control the automated parking system. The real time synoptic map may include for example a real time vehicle transportation display, a storage layers display, a parking occupancy display, a throughput and statistical parameters display, a real time control screen, a troubleshooting operations display, and more. The synoptic map may further provide a real time movements display of vehicles, zooming in and out of a map area, a moving view within the map boundaries, color coded views, and an interactive control by clicking elements on the map.

Figure 7:
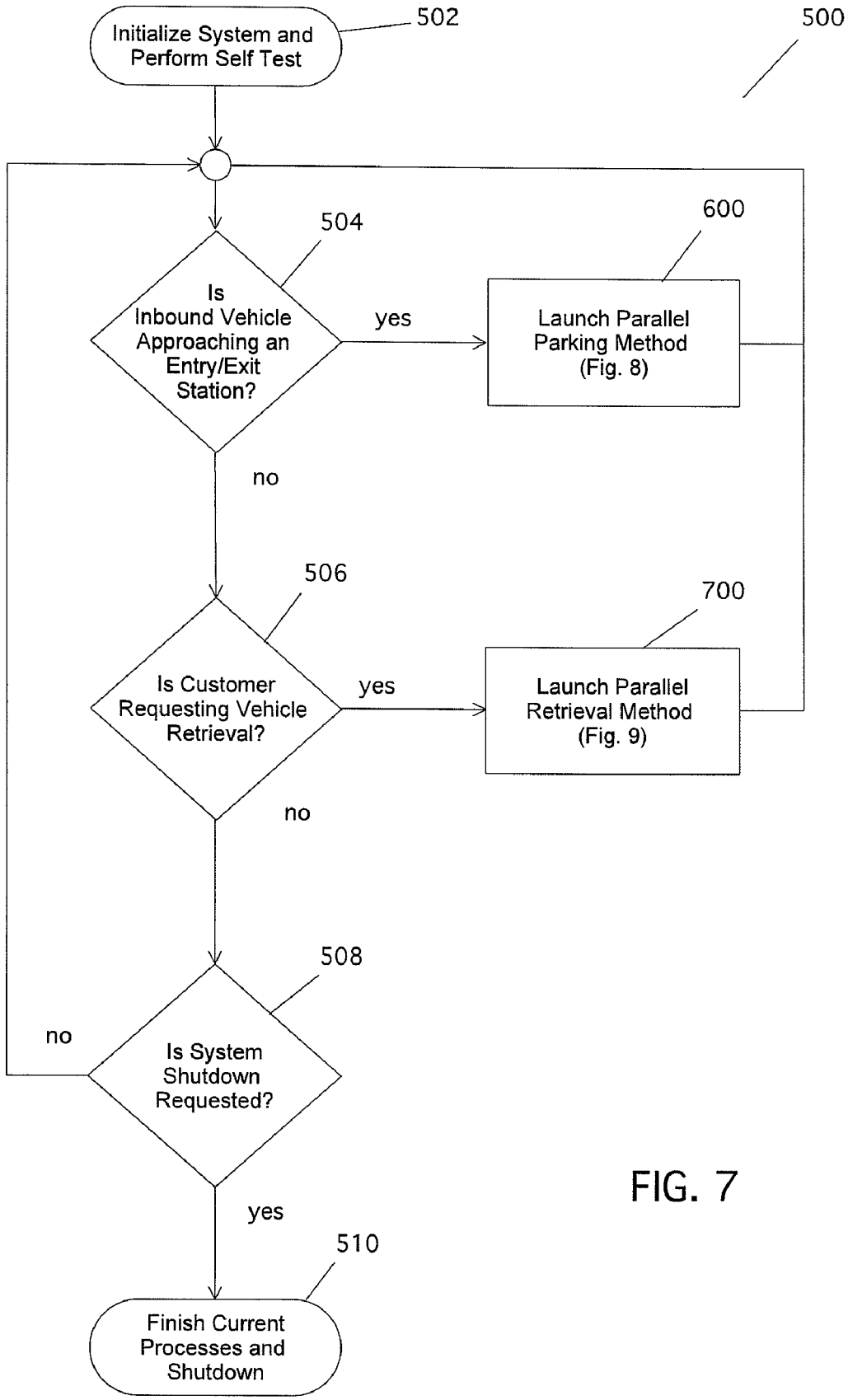
FIG. 7 is a flow chart illustrating the overall operation of the distributed control system for the three-dimensional automated vehicle parking garage in accordance with the present invention.

FIG. 7 is a flow chart showing the automated parking/retrieval method 500 the distributed control system 44. The automated parking/retrieval method 500 starts at step 502 where the distributed control system 44 initializes and performs self tests of its controller programs 46 and the central management software. Once the initialization and self testing has been completed at step 502, the automated parking/retrieval method 500 proceeds to step 504.

At step 504, the automated parking/retrieval method 500 determines whether or not an inbound vehicle 12 is approaching one of the entry/exit stations 24. If an inbound vehicle 12 is approaching one of the entry/exit stations 24, the parking/retrieval method 500 follows the "yes" branch to step 600, where the parking method 600 is launched as will be described below in connection with FIG. 8. Once the parking method 600 is completed, the parking/retrieval method 500 returns to step 504 to monitor the approach of any inbound vehicle 12.

If at step 504 the parking/retrieval method 500 determines that no inbound vehicle is approaching one of the entry/exit stations 24, the parking/retrieval method 500 follows the "no" branch to step 506. At step 506, the parking/retrieval method 500 determines whether or not there is a customer request to retrieve a vehicle from the parking garage. If at step 506 there is a customer request to retrieve the vehicle, the parking/retrieval method 500 follows the "yes" branch to step 700, where the retrieval method 700 is launched as will be described below in connection with FIG. 9. Once the retrieval method 700 is completed, the parking/retrieval method 500 returns to step 504 to monitor the approach of any inbound vehicle 12.

If at step 506 the parking/retrieval method 500 determines that no customer request to retrieve a vehicle exists, the parking/retrieval method 500 follows the "no" branch to step 508. At step 508, the parking/retrieval method 500 determines whether or not there is a system shutdown request. If at step 508 there is no system shutdown request, the parking/retrieval method 500 follows the "no" branch back to step 504, and the parking/retrieval method 500 continues to monitor the parking garage for the approach of inbound vehicles and for customer requests to retrieve parked vehicles. If at step 508 there is a system shutdown request, the parking/retrieval method 500 follows the "yes" branch to step 510, where the distributed control system 44 shuts down.

Figure 8:
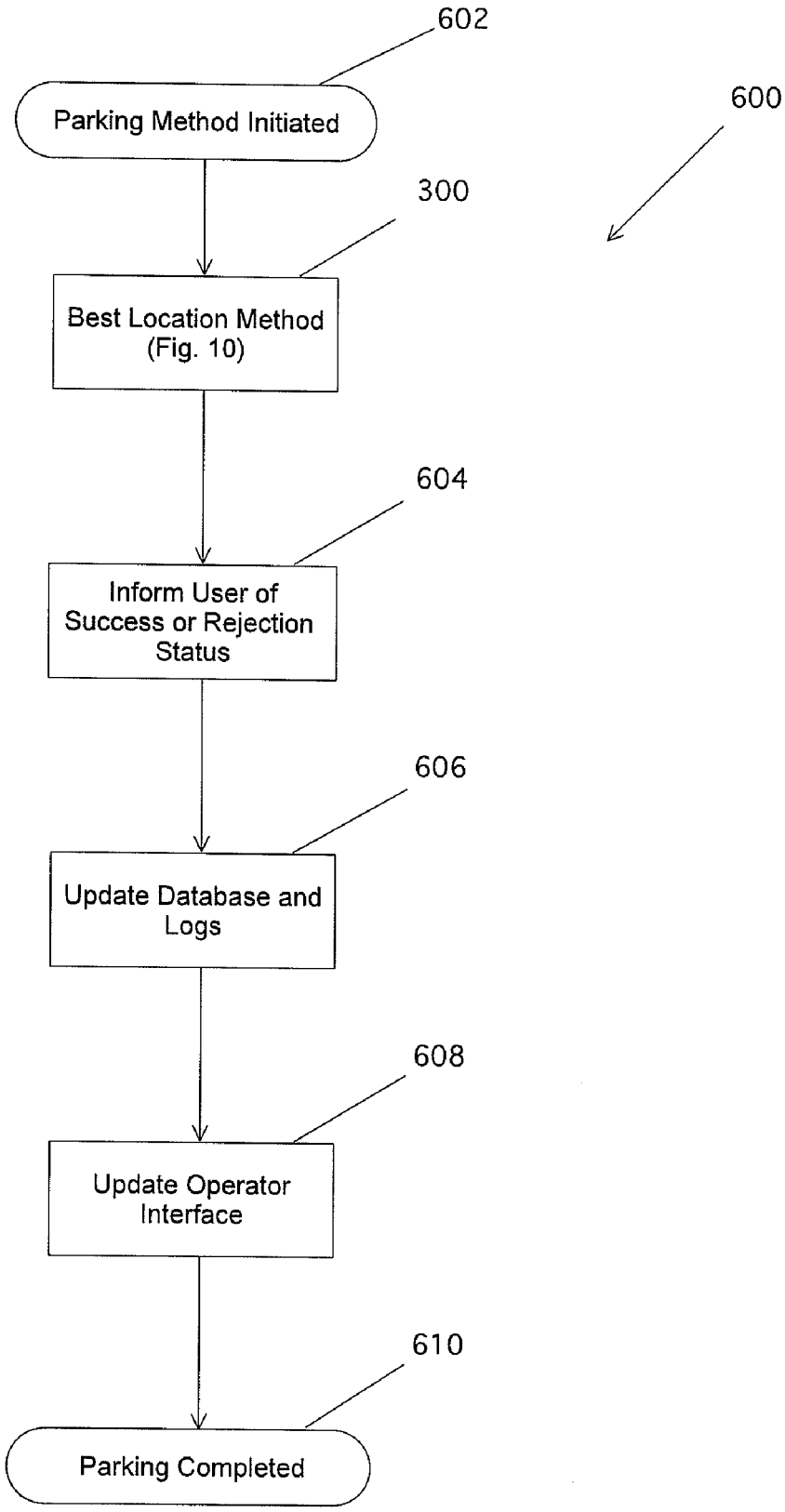
FIG. 8 is a flow chart illustrating the operation of the parking process of the distributed control system for the three-dimensional automated vehicle parking garage in accordance with the present invention.

Once the parking method 600 has been launched at step 600 in FIG. 7, the parking method 600 is initiated at step 602 in FIG. 8. From Step 602, the parking method 600 proceeds to the best location method 300. The best location method 300 will be described in greater detail below in connection with FIG. 10. After the best location method 300 is completed, the parking method 600 proceeds to step 604, where the customer is informed whether or not the vehicle 12 can be accepted for parking. From step 604, the parking method 600 proceeds to step 606 where the database (such as database 108, FIG. 6) and logs (such as logs 140, FIG. 6) Are updated to reflect either the acceptance or the rejection of the vehicle. From step 606, the parking method 600 proceeds to step 608, where the data relating to the accepted or rejected vehicle is displayed to the operator by means of the graphical user interface 102 of the central management computer 98. Once the vehicle data has been displayed to the operator at step 608, the parking method 600 proceeds to step 610, and the parking method 600 is completed.

Figure 10:
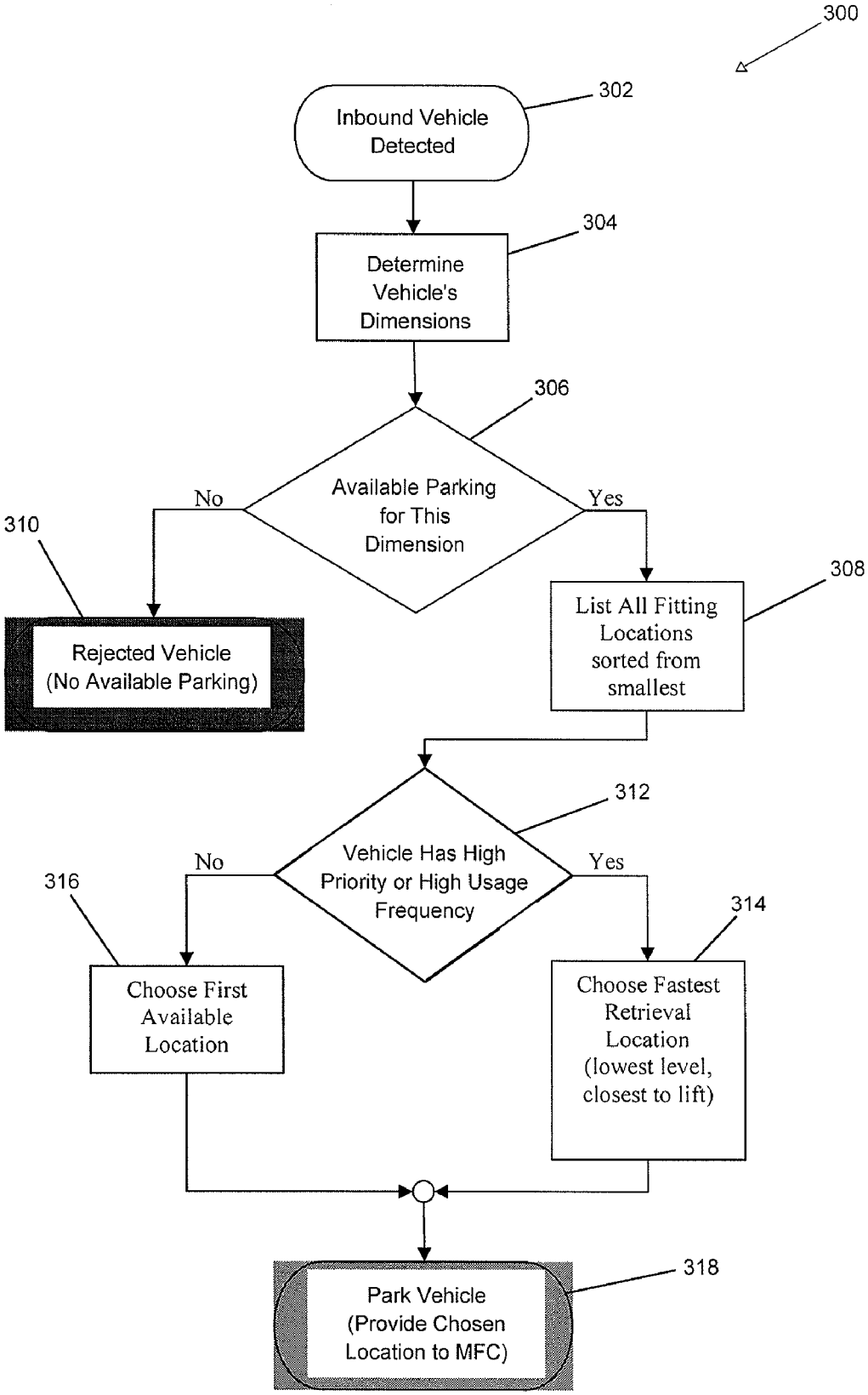
FIG. 10 is a flow chart illustrating the operation best location method of the distributed control system for the three-dimensional automated vehicle parking garage in accordance with the present invention.

FIG. 10 shows the best location method 300 for selecting the best location for a vehicle 12 presented for parking at the entry/exit station 24. The central management software automatically manages the parking spaces by implementing the best location method 300, which determines the best parking space for each vehicle presented for parking, based on all the information defined for the automated parking system such as the vehicle's dimensions, owner, priority, usage history, the automated parking system's current load and capacity, safety considerations, and more. The best location method 300 begins at step 302 when the vehicle 12 is detected at one of the entry/exit stations 24. The best location method 300 proceeds from step 302 to step 304, where the vehicle's dimensions are determined. The dimensions are determined by sensors in the entry/exit station 24 even if the vehicle's dimensions are already contained in database 108 of the central management computer 98. Once the vehicle's dimensions have been determined at step 304, the method 300, proceeds to step 306. At step 306, the best location method 300 determines if any parking space is available for the measured dimensions of the vehicle. If at step 306, the method determines that no parking space is available large enough to accommodate the vehicle, the method follows the "no" branch to step 310 where the vehicle is rejected for parking, and the method returns to step 604, FIG. 8, where customer is informed of the rejection of the vehicle.

If, however, at step 306, the best location method 300 determines that there is a parking space large enough to accommodate the vehicle, the method 300 follows the "yes" branch to step 308 where all of the available locations that will accommodate the vehicle are listed and sorted from smallest parking space that will accommodate the vehicle to largest available parking space.

From step 308, and the method 300 proceeds to step 312, where the method 300 determines the priority or usage frequency of the vehicle. If at step 312, the method 300 determines that the vehicle does not have a high priority or a high usage frequency, the method proceeds along the "no" branch to step 316. At step 316, the method 300 chooses the first available parking space from the list of parking spaces generated at step 308. With the location of the parking space selected at step 316, the method 300 proceeds to step 318 where the method communicates the chosen parking space to the MFC software module 106. The MFC software module 106 issues transport instructions to the distributed control system 44 for parking the vehicle in the chosen parking space.

If, however, at step 312, the method 300 determines that the vehicle has a high priority or high usage frequency, the method 300 follows the "yes" branch to step 314. At step 314, the method 300 chooses a fastest retrieval location for the parking space. A fast retrieval location for a parking space, is a parking space located at the lowest floor level and closest to the elevator. Once the fast retrieval location for the parking space has been determined at step 314, the method 300 proceeds to step 318 where the MFC software module 106 issues instructions for transporting the vehicle to that fast retrieval parking space.

Figure 9:
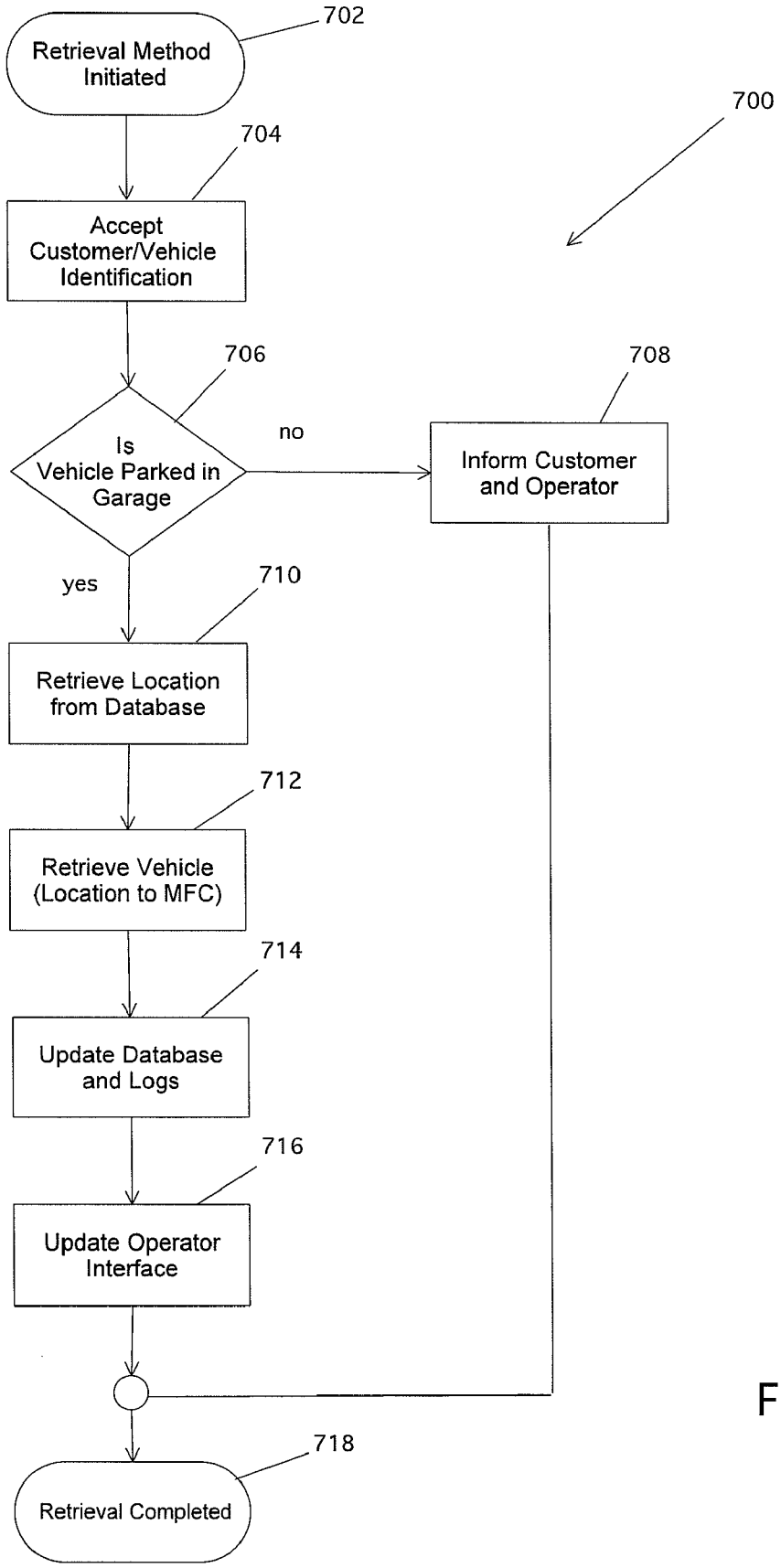
FIG. 9 is a flow chart illustrating the operation of the retrieval process of the distributed control system for the three-dimensional automated vehicle parking garage in accordance with the present invention.

Once the retrieval method 700 has been launched at step 700 in FIG. 7, the retrieval method 700 is initiated at step 702 in FIG. 9. From step 702, the retrieval method 700 proceeds to step 704, where the retrieval method 700 accepts the customer/vehicle identification from the customer seeking to retrieve a vehicle from the parking garage. Based on establishing the identity of the customer or the vehicle, the retrieval methods 700 proceeds to step 706, where the retrieval methods 700 determines whether or not the vehicle is parked in the garage 10. If the retrieval methods 700 determines at step 706 that a vehicle matching the customer/vehicle identification is not parked in the garage 10, the retrieval method 700 follows the "no" branch to step 708. At step 708, the retrieval method 700 informs both the customer and the operator that the vehicle is not parked in the garage 10, and the method 700 proceeds to the retrieval completed step 718.

If at step 076, the retrieval method 700 confirms that the vehicle is parked in the garage 10, the retrieval methods 700 follows the "yes" branch to step 710. At step 710, the retrieval method 700 ascertains the location of the vehicle from the database 108. The retrieval methods 700 then proceeds to step 712, where the parking space information in the database for the parked vehicle is communicated to the MFC 106. As previously described, the MFC provides the necessary commands to the individual controllers 48, 52, 56, and 60 in order to retrieve the vehicle from the parking space and deliver the vehicle to one of the entry/exit stations 24. From step 712, the retrieval method 700 proceeds to step 714, where the database 108, and the logs 140 in the database, are updated. The retrieval method a 700 then proceeds to step 716, where the operator is updated by means of the interface 102. Once the database and the operator interface have been updated, the retrieval method 700 proceeds to the retrieval completed step 718.

The central management computer 98 provides for a number of enhanced features. For example, the central manager computer 98 synchronizes the individual controllers following semi-automatic operations or manual updates. In addition the central management computer 98 also provides for:

- maintaining an online database of all physical parking spaces, keeping real time information for each parking space including its location (coordinates) within the parking area, its dimensions, whether a vehicle is currently parked in it, details of the parked vehicle, etc.,
- allocating a specific vehicle to the smallest available parking space that can hold that vehicle, when parking spaces have different dimension limitations (height/width/length)
- allowing pre-allocation (reservation) of parking spaces for certain vehicles or users,
- allowing pre-allocation (reservation) of parking spaces for a certain percentage of the total capacity to ensure minimum availability,
- allowing parking space selection based on in and out frequency-vehicles with high usage (frequently getting in and out of the parking garage) should be parked in location closer to the entry/exit stations, allowing faster retrieval,
- automatic learning of the in and out frequency of each vehicle based on accumulated usage history, and in
- allowing manual blocking and unblocking of parking spaces for any purpose (maintenance, pre allocation, management policy etc.).

While this invention has been described with reference to preferred embodiments thereof, it is to be understood that variations and modifications can be affected within the spirit and scope of the invention as described herein and as described in the appended claims.

I claim:

1. An automated system for a three-dimensional warehousing facility for receiving an item at a delivery bay, storing the item in a storage space, and retrieving the item from the storage space, the automated system comprising:

a. mechanical elements for transporting the item between the delivery bay and the storage space; and b. a distributed control system including:

i. a plurality of independent controllers, each with an associated controller program and each associated with one of the mechanical elements; and ii. a network interconnecting the controllers for communications among the controllers, wherein each of the controllers, running its associated controller program, controls the operation of its associated mechanical element and communicates, via the network, with other controllers associated with other mechanical elements without the need for a central management computer running central management software and wherein the controller programs are distributed among the controllers to enable the controllers to control the whole automated system without the need for a central management computer running central management software.

2. The automated system of claim 1, wherein the controller has a central processor unit, a memory for storing the controller program including a controller data structure, and input/output ports.

3. The automated system of claim 2, wherein the controller data structure includes operating parameters for the associated mechanical element and wherein the operating parameters are used by the controller program to control the operation of the associated mechanical element.

4. The automated system of claim 3, wherein the operating parameters include one or more of a slack rope condition in an elevator, a motor rotation over speed, an overweight item, and emergency stop mechanisms.

5. The automated system of claim 1, wherein the controller program computes a motion trajectory for the associated mechanical element, and the controller controls the operation of the mechanical element by means of the motion trajectory.

6. The automated system of claim 1, wherein the controller program in one of the controllers can take over the operations of another one of the controllers in the event that the other one of the controllers malfunctions.

7. The automated system of claim 1, wherein one or more of the controllers has a graphical operator panel associated with the one or more controllers for providing instructions to the one or more controllers and displaying status information relating to the operation of the associated mechanical element.

8. The automated system of claim 1, wherein the mechanical element has a motor with an encoder connected via a feedback loop to the associated controller in order to determine the status of the mechanical element.

9. The automated system of claim 1, wherein the automated system has one or more sensors connected to the controller in order to determine the status of the associated mechanical element.

10. The automated system of claim 1, wherein one or more of the controllers has a cellular gateway or modem for communicating status information about the controller over a cellular network to a remote receiver.

11. The automated system of claim 1, wherein the distributed control system further includes a central management computer connected to the network and in communication with the controllers wherein the central management computer has a central management program for providing instructions to the controllers and receiving status information from the controllers.

12. The automated system of claim 11, wherein the central management computer includes a parking management module, a computer operator panel, a communications module, and a central database, and wherein the central management program transmits high-level commands to the controllers via the network, and each controller by means of its controller program translates the high-level commands into sequential operations for the associated mechanical element.

13. The automated system of claim 12, wherein the central database in the central management computer stores item identification records, storage space locations, and performance logs.

14. The automated system of claim 11, wherein central management computer further has a material flow control software module which receives high-level commands from the central management program and translates the high-level commands into sequential operations for transmission via the network to one or more of the controllers.

15. The automated system of claim 11, wherein the central management computer receives status information from the controllers and displays such information on a computer operator panel of the central management computer.

16. An automated method for controlling the operation of a three-dimensional warehousing facility for receiving an item at a delivery bay, storing the item in a storage space, and retrieving the item from the storage space, the automated method comprising the steps of:

a. transporting the item between the delivery bay and the storage space by means of mechanical elements; and b. controlling the mechanical elements by means of a distributed control system including:

i. a plurality of independent controllers, each with an associated controller program and each associated with one of the mechanical elements; and ii. a network interconnecting the controllers for communications among the controllers, wherein each of the controllers, running its associated controller program, controls the operation of its associated mechanical element and communicates, via the network, with other controllers associated with other mechanical elements without the need for a central management computer running central management software and wherein the controller programs are distributed among the controllers to enable the controllers to control the whole automated system without the need for a central management computer running central management software.

17. The automated method of claim 16, wherein the controlling step further includes storing operating parameters in a controller data structure and using the operating parameters by the controller program to control the operation of the associated mechanical element.

18. The automated method of claim 17, wherein the operating parameters include one or more of a slack rope condition in an elevator, a motor rotation over speed, an overweight item, and emergency stop mechanisms.

19. The automated method of claim 16, wherein the controlling step includes computing a motion trajectory for the associated mechanical element and controlling the operation of the mechanical element by means of the motion trajectory.

20. The automated method of claim 16, wherein the controlling step includes allowing the controller program in one of the controllers to take over the operations of another one of the controllers in the event that the other one of the controllers malfunctions.

21. The automated method of claim 16, wherein the controlling step includes providing instructions to the controller by means of a graphical operator panel associated with the controller and displaying status information relating to the operation of the associated mechanical element by means of the graphical operator panel.

22. The automated method of claim 16, wherein the controlling step includes generating an encoded signal relating to the status of the mechanical element and derived from an encoder on the mechanical element and connecting the encoded signal via a feedback loop to the associated controller in order to determine the status of the mechanical element.

23. The automated method of claim 16, wherein the controlling step includes generating a sensor signal relating to the status of the mechanical element and derived from a sensor in communication with the mechanical element and connecting the sensor signal via a feedback loop to the associated controller in order to determine the status of the mechanical element.

24. The automated method of claim 16, wherein the automated method further includes one or more of the controllers, having a cellular gateway or modem, communicating with a remote receiver over a cellular network.

25. The automated methods of claim 16, wherein the automated method further includes providing the distributed control system with a central management computer connected to the network and in communication with the controllers and providing a central management program running on the central management computer for transmitting instructions to the controllers from the central management computer and for receiving status information from the controllers via the network.

26. The automated method of claim 25, wherein the automated method includes transmitting high-level commands to the controllers via the network and each controller by means of its controller program translating the high-level commands into sequential operations for the associated mechanical element.

27. The automated method of claim 25, wherein the automated method includes a material flow control software module of the central management computer receiving high-level commands from the central management program and translating the high-level commands into sequential operations for transmission via the network to one or more of the controllers.

28. The automated method of claim 25, wherein the automated method includes storing item identification records, storage space locations, and performance logs in a central database in the central management computer.

29. The automated method of claim 25, wherein automated method includes receiving status information from the controllers and displaying such information on a computer operator panel of the central management computer.

* * * * *